US012000097B1

(12) United States Patent
Knapp

(10) Patent No.: US 12,000,097 B1
(45) Date of Patent: Jun. 4, 2024

(54) MOBILE JOINT SEAL REMOVAL AND FILL MACHINE FOR HIGHWAY JOINTS

(71) Applicant: Ronald A. Knapp, Bonita Springs, FL (US)

(72) Inventor: Ronald A. Knapp, Bonita Springs, FL (US)

( * ) Notice: Subject to any disclaimer, the term of this patent is extended or adjusted under 35 U.S.C. 154(b) by 62 days.

(21) Appl. No.: 17/655,114

(22) Filed: Mar. 16, 2022

Related U.S. Application Data

(60) Provisional application No. 63/161,743, filed on Mar. 16, 2021.

(51) Int. Cl.
*E01C 23/09* (2006.01)
*E01C 11/10* (2006.01)

(52) U.S. Cl.
CPC ..... *E01C 23/096* (2013.01); *E01C 11/10* (2013.01)

(58) Field of Classification Search
CPC ..... E01C 11/10; E01C 23/09; E01C 23/0906; E01C 23/096
See application file for complete search history.

(56) References Cited

U.S. PATENT DOCUMENTS

| | | | | |
|---|---|---|---|---|
| 2,354,586 | A * | 7/1944 | Fischer | E04F 21/0038 156/484 |
| 3,176,405 | A * | 4/1965 | Carver | E01C 23/0906 404/93 |
| 3,200,482 | A | 8/1965 | Brown | |
| 3,416,415 | A | 12/1968 | Worson | |
| 3,432,969 | A * | 3/1969 | Byttebier | E01H 1/08 451/92 |
| 3,791,696 | A | 2/1974 | Riley | |
| 4,407,605 | A * | 10/1983 | Wirtgen | E01C 23/096 404/90 |
| 5,468,094 | A | 11/1995 | Vanderpan et al. | |
| 5,492,431 | A | 2/1996 | Rasmussen et al. | |
| 9,010,310 | B2 * | 4/2015 | Bockes | E01C 23/0933 404/94 |
| 9,039,098 | B2 * | 5/2015 | Fanslow | B27B 5/10 299/39.3 |
| 9,315,955 | B2 | 4/2016 | Knapp | |

FOREIGN PATENT DOCUMENTS

| | | | | |
|---|---|---|---|---|
| CN | 208395693 U | | 1/2019 | |
| CN | 110468674 A | | 11/2019 | |
| CN | 110685208 A | * | 1/2020 | E01C 23/03 |
| EP | 6788 A | * | 1/1980 | E01C 23/096 |
| EP | 3023545 A1 | | 1/2019 | |
| KR | 101943756 B1 | | 1/2019 | |

* cited by examiner

*Primary Examiner* — Gary S Hartmann
(74) *Attorney, Agent, or Firm* — AVEK IP, LLC; Kent R. Erickson

(57) ABSTRACT

A machine for removing and filling roadway joints includes a laterally expandable main frame mounted to a vehicle, a horizontal track beam suspended from the main frame, a joint seal removing assembly suspended from a track beam, and a joint filling assembly attached to an end of the track beam. The joint seal removal assembly includes a pair of guide wheels for maintaining alignment with the roadway joint. The joint seal removal assembly includes a rotary broom, a joint seal router, a rotary abrader, a sandblaster, high-pressure air blaster, a high pressure water blaster and a heat lance. The joint filling assembly includes a guide wheel and a sealant applicator for dispensing sealant into the roadway joint.

33 Claims, 12 Drawing Sheets

MOBILE JOINT SEAL REMOVAL AND FILL MACHINE FOR HIGHWAY JOINTS

CROSS REFERENCE TO RELATED APPLICATIONS

This application claims priority to U.S. Provisional Patent Application No. 63/161,743, filed on Mar. 16, 2021, the disclosure of which is incorporated herein, in its entirety, by reference.

FIELD OF THE INVENTION

The invention relates generally to the field of highway and road maintenance machines. More specifically, the invention relates to a machine for removal and replacement of seals in longitudinal highway joints.

BACKGROUND OF THE INVENTION

Roadways constructed using concrete slabs often contain joints separating individual slabs from one another. These joints may be perpendicular to the desired direction of travel (often referred to as transverse joints) or may be parallel to the direction of travel (often referred to as longitudinal joints). Joints between the concrete slabs often contain a flexible or resilient polymeric base layer, such as foam or rubber, and a sealing layer of tar or the like. Over time, via normal wear, extreme temperatures, or other extenuating circumstances, the joint seals degrade and require removal and replacement. A current practice for removing and replacing joint seals requires the use of multiple different types of tools, specifically for cutting, cleaning, or filling the joint.

Typically, a "saw and seal" process uses a standalone saw assembly having one or more stacked saw blades to cut an existing seal away from the sides of the joint. These saw blades may or may not fill the width of the joint, or may exceed the width of the joint, since they are not easily adjustable. A separate wire brush and/or sandblaster may be used to remove additional joint seal material which was not removed by the saw blades. In some instances, a pressurized air wand may be used as well. To install the new joint seal, it is common to install a flexible or resilient backer rod by hand, where a first worker dispenses the backer rod using a spool, while a second worker presses it into place using a hand tool. Then, another worker may use a separate tar applicator and dispenser to inject the tar or appropriate sealant material into the joint by hand. The debris of the previous joint must then be collected and removed, typically using handheld or worn air blowers to direct the debris accordingly, where it can be swept up and collected by a separate sweeper.

There is a need, therefore, for a labor saving approach to removing existing joint seals, preparing the joint to receive a new seal, and then applying a new seal.

In addition to longitudinal joints between concrete slabs, asphalt roads may have similar longitudinal joints formed between adjacent lanes of travel. The joints are sometimes referred to as cold joints, because they are formed when a fresh, hot layer of asphalt is laid adjacent to a cold, previously laid layer of asphalt. Unlike the joints between concrete slabs, asphalt cold joint seals typically lack a flexible or resilient polymeric base layer, and may consist solely of tar sealant. Similar to joints between concrete slabs, asphalt joints can degrade over time and require repair and/or replacement as part of regular maintenance. Therefore, it may be particularly useful for a mobile roadway joint seal removal and joint fill machine to be able to repair and/or replace both longitudinal concrete joint seals, as well as asphalt cold joints.

SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to an embodiment of the invention, a machine for removing and replacing a joint seal from a joint between pavement slabs includes a frame, a joint seal router, and a sealant applicator. The joint seal router is mounted on the frame and is operable to remove a joint seal from within a roadway joint. A sealant applicator is also mounted to the frame, the applicator supported in longitudinal alignment with the router. The sealant applicator has a dispensing nozzle positionable to dispense joint seal material into the joint. In some embodiments, the machine may further include a first guide wheel mounted on the frame. The first guide wheel has a guide portion positionable within the joint for guiding the joint seal router and sealant applicator relative to the joint.

In an embodiment, the joint seal router comprises a circular saw, including first and second a saw blades mounted on an axle for rotation therewith. The circular saw also includes a compressible spacer disposed between the first and second saw blades. The first and second saw blades may engage with bearings positioned in spaced relation from the axle to engage an outwardly facing surface of the respective first and second saw blades. The bearings engage with the respective saw blades to angularly offset a path of rotation of each of the first and second saw blades relative to a direction of travel of the machine.

According to another embodiment of the invention, a machine for removing and replacing a joint seal between slabs includes a main frame, a track beam suspended from the main frame, a joint seal removing assembly, and a joint seal filling assembly. The joint seal removing assembly is mounted on a carriage which is moveably mounted on the track beam, the carriage being operable to move longitudinally in either direction along the track beam. The joint seal removing assembly comprises a joint seal removing means for removing the joint seal from the joint. The joint seal filling assembly is mounted on the machine in a fixed longitudinal position relative to the track beam. The joint seal filling assembly includes a sealant applicator having a dispensing nozzle positionable to dispense joint seal material into the joint.

BRIEF DESCRIPTION OF THE DRAWINGS

Illustrative embodiments of the present disclosure are described in detail below with reference to the attached drawing figures.

DETAILED DESCRIPTION OF THE PREFERRED EMBODIMENTS

Figure 1:
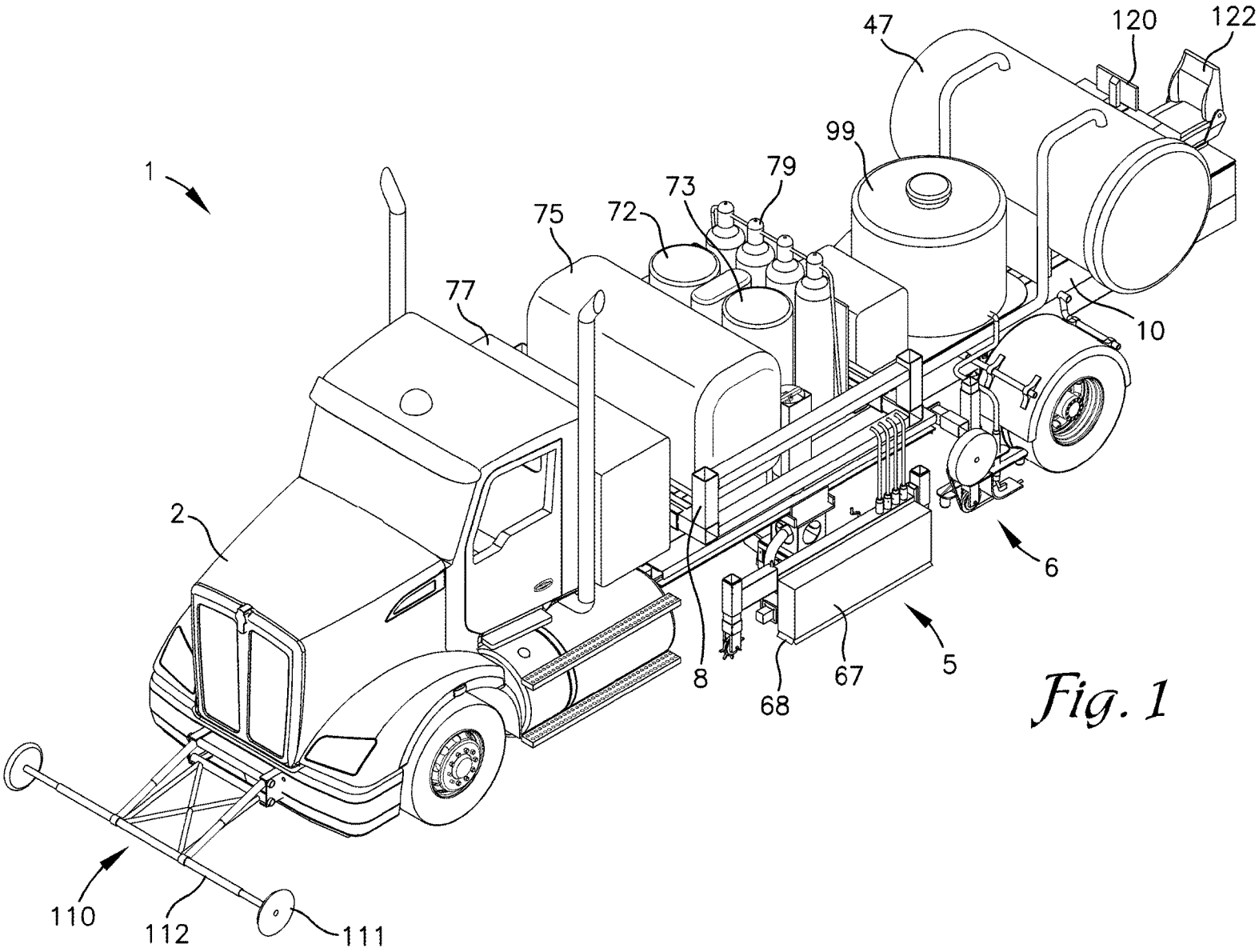
FIG. 1 is a front perspective view of a mobile joint seal removal and fill machine.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology may be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
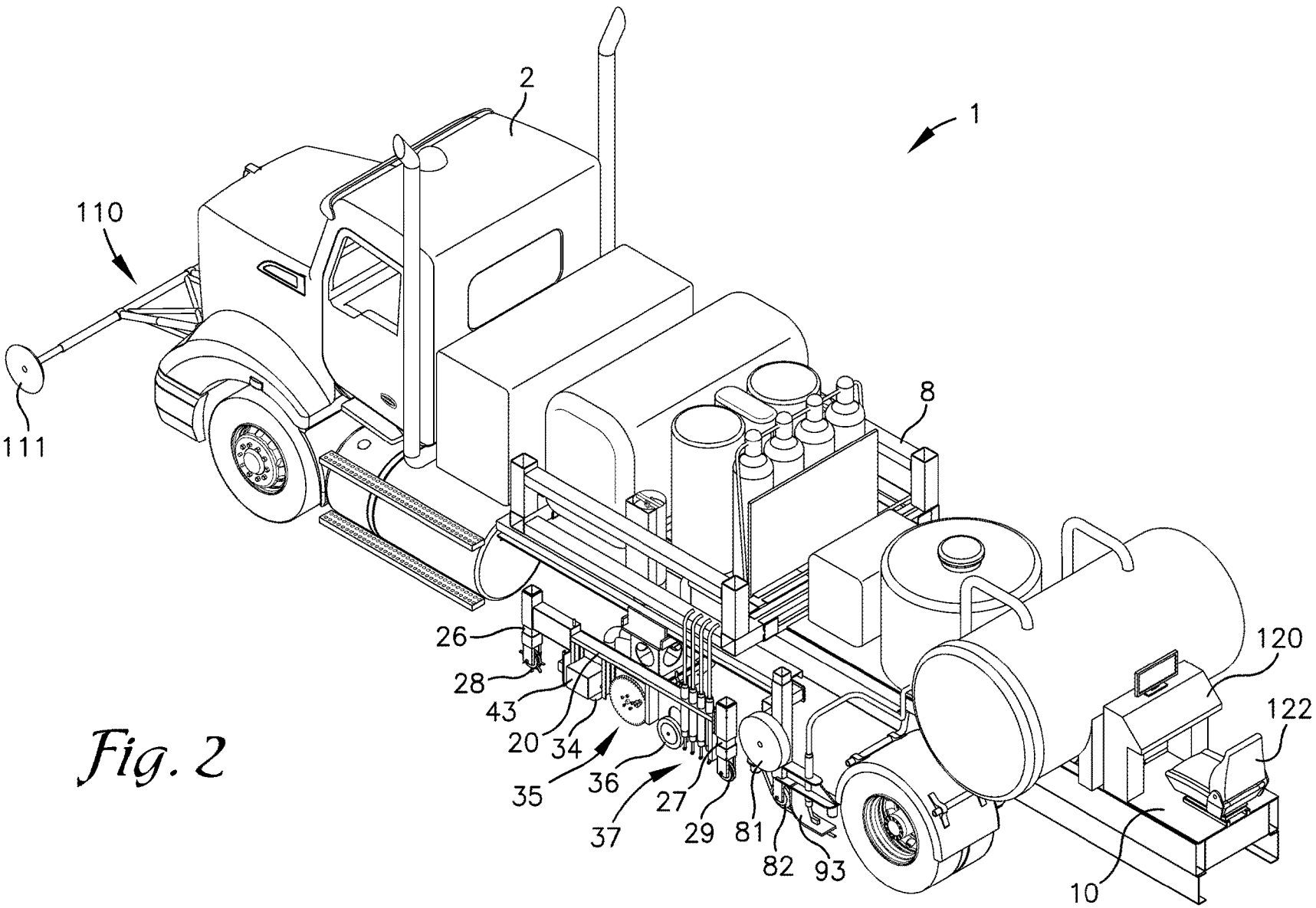
FIG. 2 is a rear perspective view of the mobile joint seal removal and fill machine of FIG. 1 with a housing for a joint seal removal assembly and a shroud for a circular saw assembly removed to show detail thereof.
Figure 3:
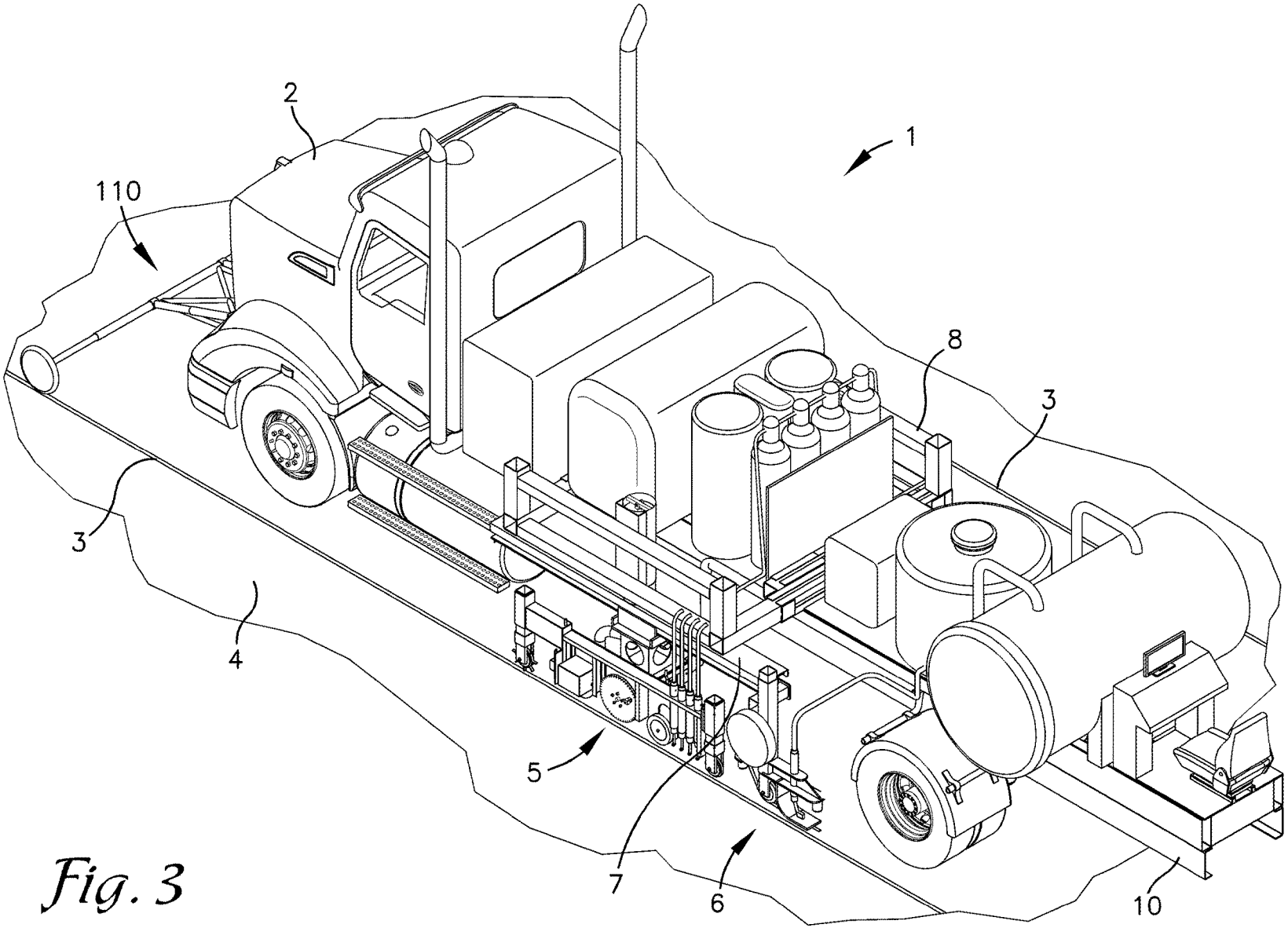
FIG. 3 is a rear perspective view of the mobile joint seal removal and fill machine of FIG. 1 within a roadway joint with the housing for the joint seal removal assembly and the shroud for the circular saw assembly removed to show detail thereof.

An embodiment of a mobile joint seal removal and fill machine 1 mounted on a vehicle 2 is shown in FIGS. 1-3 for removing and replacing seals (not shown) in joints 3 such as joints 3 formed between roadway slabs 4. The machine 1 includes at least one joint seal removal assembly 5 and at least one joint fill assembly 6. The assemblies 5 and 6 may be mounted on a track beam 7 rotatably suspended from a laterally expandable frame 8. In the embodiment shown, the expandable frame 8 may be referred to as a main frame 8 and includes a base frame 9 fixedly mounted on a vehicle frame 10 and a subframe 11 extendable and retractable relative to the base frame 9.

The mobile expandable frame 8 may be constructed similar to the mobile expandable frame disclosed by my prior U.S. Pat. No. 9,315,955 B2 entitled Saw and Drill Machine for Paved Slabs, the disclosure of which is incorporated herein by reference. The expandable frame 8 preferably spans the width of the vehicle frame 10 and telescopically extends and retracts outwards from the vehicle frame 10 to position the joint seal removal assembly 5 and joint fill assembly 6 attached thereto in alignment with the desired joint 3. Extension and retraction of the expandable frame 8 may be accomplished using a linear actuator, a hydraulic actuator, electric motor, or any other methods of telescopic extension or linear actuation now known or later developed.

In the illustrated embodiment, the expandable frame 8 is mounted on the frame 10 of a flatbed truck. It is foreseen that the frame 8 may be mounted to any number of vehicle types. For example, the frame 8 may be mounted to a towable or detachable trailer, which may allow for a wider variety of automobiles to be used with the machine 1. Alternatively, the base frame 9 may be supported on wheels, rollers or tracks including a driven wheel, roller or track such that the machine 1 comprises a self-propelled apparatus which may allow for more compact configuration of the components of the machine 1 or offer additional practical or economic benefit.

The track beam 7 is suspended from the laterally extendable frame 8 on a vertically extendable mast or connecting assembly 12 mounted on the subframe 11. The subframe 11 includes spaced apart frame support arms 13 which are slidably received in receivers 14 fixedly mounted on base frame 9. Actuators, not shown, such as hydraulic actuators, connected between the arms 13 and respective receivers 14 are operable to extend and retract the mast support subframe 11 and attached mast 12 relative to the base frame 9. In the embodiment shown, the mast 12 is formed from an outer tube 15 fixedly mounted to the mast support subframe 11 and an inner tube 16 positioned within the outer tube 15 and extendable and retractable relative thereto by a linear actuator. In the embodiment shown, the linear actuator is a hydraulic actuator 17 connected between the outer tube 15 and inner tube 16 on actuator mounts **18*a* and 18*b* secured in the outer and inner tubes respectively. The inner tube 16 is suspended from the outer tube 15 on hydraulic actuator 17 such that the inner tube 16 is rotatable relative to the outer tube 15 through rotation of the actuator piston (not shown) relative to the actuator cylinder. A lower end of the inner tube 16 is fixedly attached, such as by welding, to an upper surface of an upper flange of the track beam 7 preferably at the center thereof. The mast 12 is operable to raise and lower the track beam 7 relative to the expandable frame 8. The telescoping connection between the track beam 7 and expandable frame 8 allows the track beam 7 (and the joint seal removal assembly 5 and joint fill assembly 6) to be lowered into place during operation, but raised when not in operation, so as to increase the overall ground clearance of the vehicle 2 and reduce the possibility of damaging the assemblies 5 and 6**.

The rotational connection of the inner tube 16 connected to track beam 7 relative to outer tube 15 connected to expandable frame 8, allows the track beam 7 and the attached joint seal removal and joint fill assemblies 5 and 6, respectively, to skew or pivot relative to the outer tube 15 of the mast 12 and relative to the expandable frame 8 to account for deviations in the alignment of the joint 3 in which the assemblies 5 and 6 are advancing and the direction of travel of the vehicle 2.

A linear and/or rotary actuation system (not shown) may be mounted between the track beam 7 and the mast support subframe 11 to allow control of the rotational position of the track beam 7 and the attached joint seal removal assembly 5 and joint fill assembly 6 relative to the outer tube 15 of mast 12 and relative to mast support subframe 11. The actuation systems or actuators for controlling extension and retraction and rotation of the track beam 7 relative to the outer tube or cylinder 15 of mast 12 may be controlled via an input device, located on the machine 1 (such as control system 120 described hereafter) or remotely, in order to position the assemblies 5 and 6 in the desired location. Alternatively, these systems may be controlled through a feedback system, whereby one or more sensors senses the alignment between the joint 3 and the joint seal removal assembly 5 and/or the joint fill assembly 6 and adjusts the longitudinal or rotational position of the inner tube 16 relative to the outer tube 15 of mast 12 in response to the sensor output.

In some embodiments, such as the embodiment shown, the machine 1 may include two sets of a joint seal removal assembly 5 and a joint filling assembly 6, disposed along opposing sides of the vehicle 2. In these embodiments, each set of assemblies 5 and 6 is mounted on a track beam 7 suspended on a mast 12 from a mast support subframe 11 of the expandable frame 8. By having one set of assemblies 5 and 6 disposed on either side of the vehicle 10, it may be possible to repair multiple parallel joints simultaneously. In the embodiment disclosed, each track beam 7 is independently rotatable relative to the expandable frame 8, i.e. the relative angle between the each track beam 7 and the portion of the expandable frame 8 to which it is attached may vary.

Figure 4:
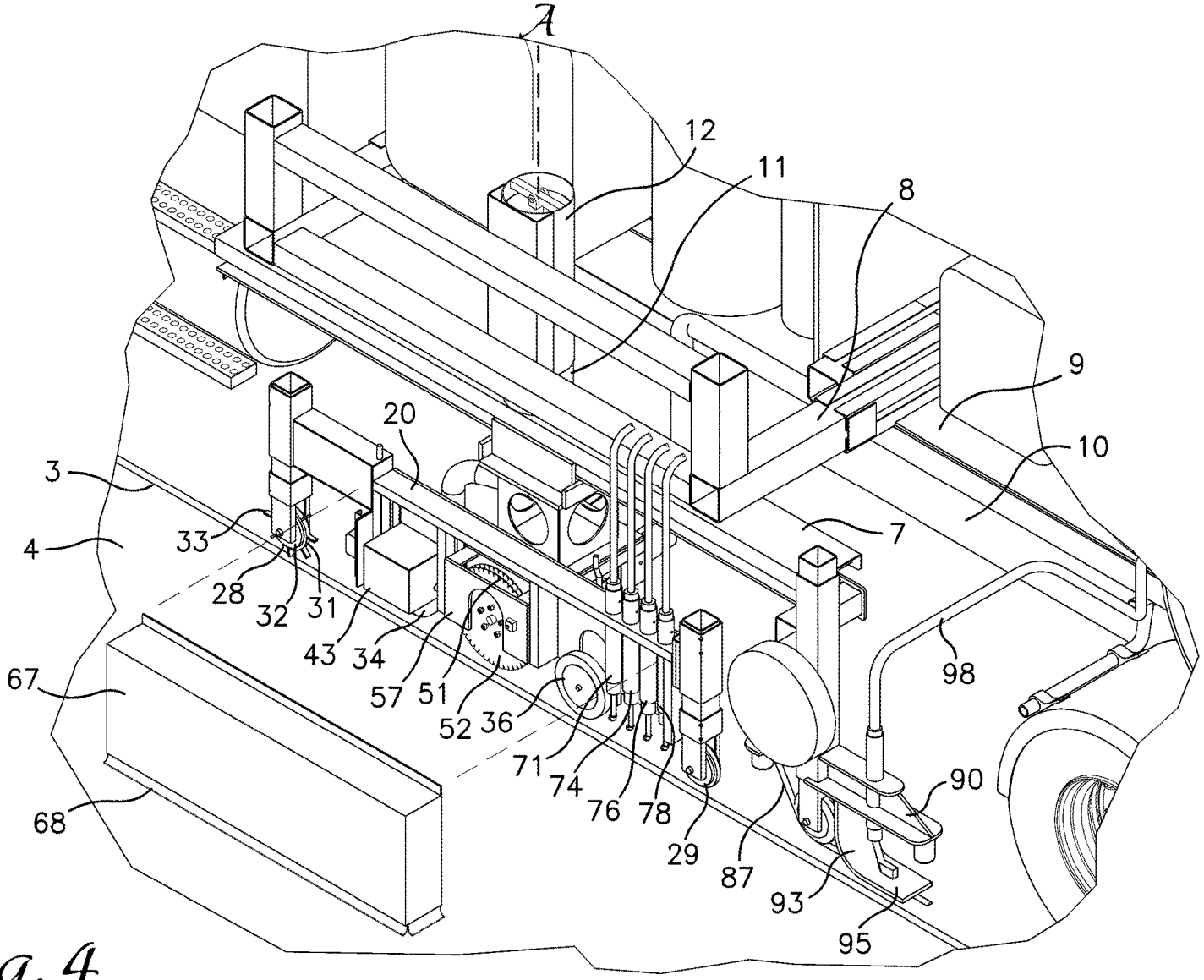
FIG. 4 is an enlarged fragmentary rear perspective view of the joint seal removal assembly and joint fill with the housing for the joint seal removal assembly shown exploded away from the joint seal removal assembly.
Figure 5:
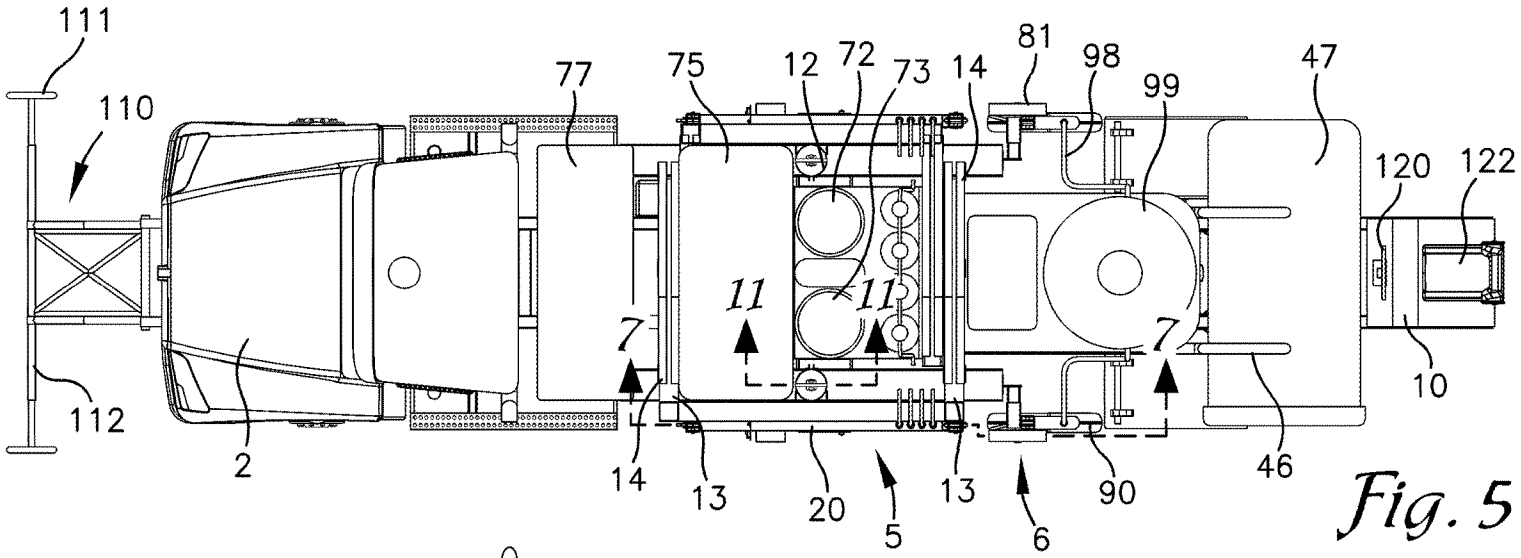
FIG. 5 is a top view of the mobile joint seal removal and fill machine of FIG. 1 with the housing for the joint seal removal assembly and the shroud for the circular saw assembly removed.
Figure 6:
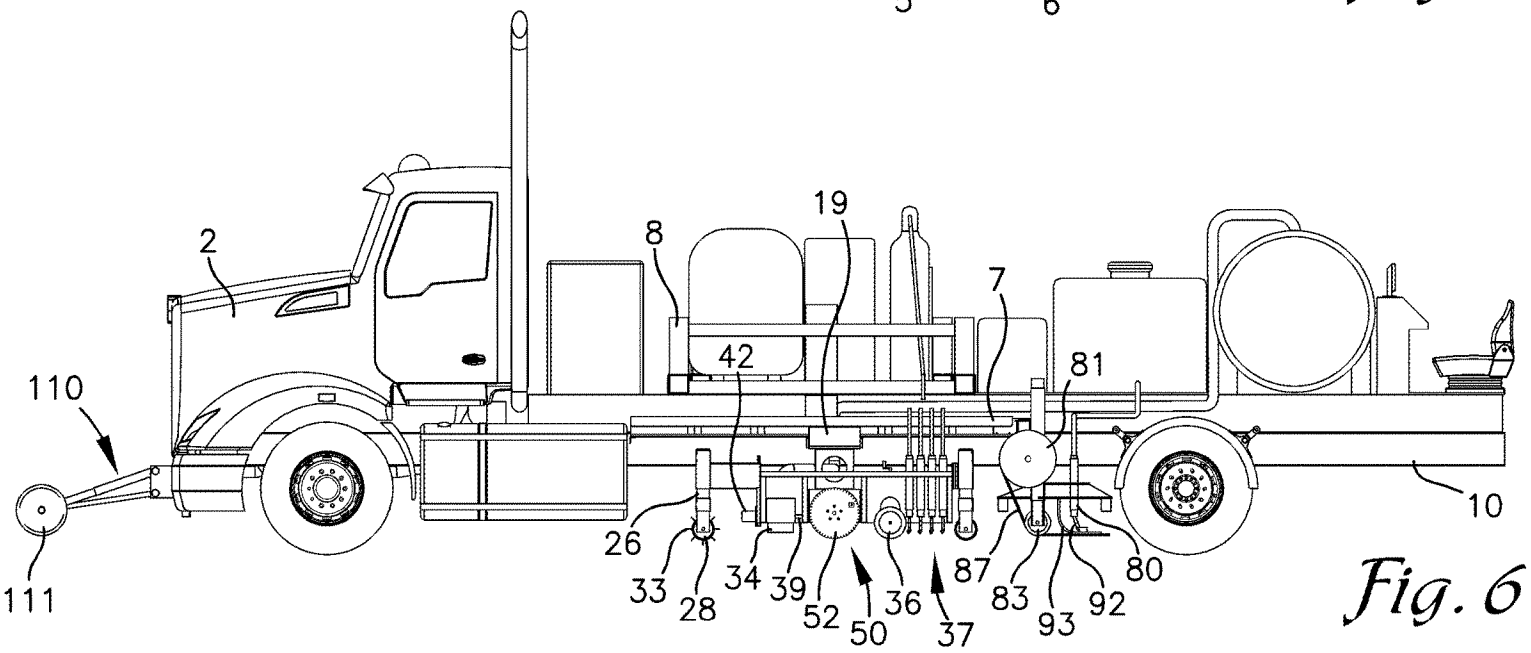
FIG. 6 is a side view of the mobile joint seal removal and fill machine of FIG. 1 with a housing for the joint seal removal assembly and the shroud for the circular saw assembly removed to show detail thereof.
Figure 7:
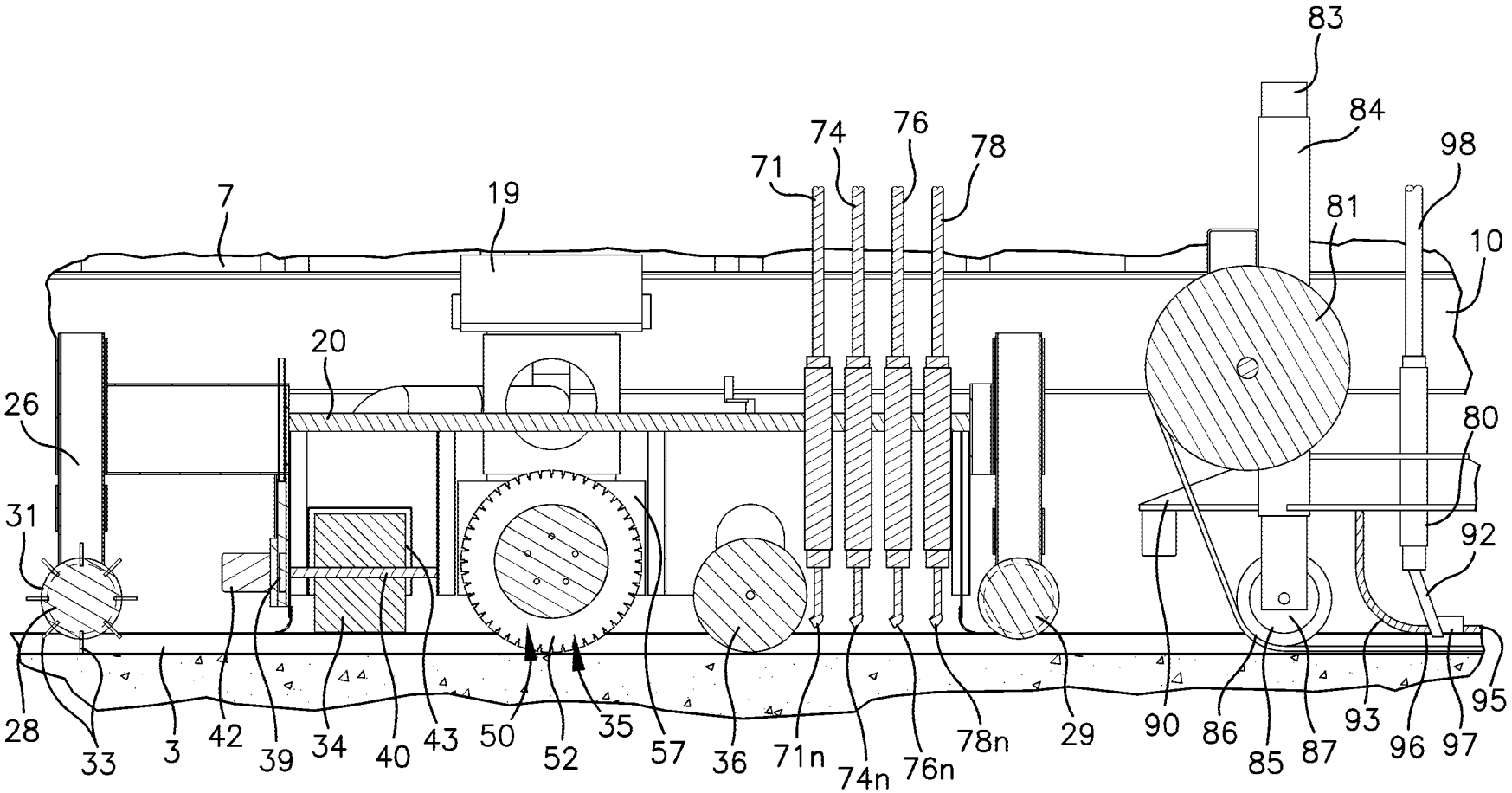
FIG. 7 is a fragmentary cross-sectional view of the joint seal assembly and joint fill assembly taken along line 7-7 of FIG. 5.

Referring now to FIGS. 4 and 7, the track beam 7 is attached to the connecting assembly or mast 12 and extends substantially horizontally when the vehicle 2 is supported on a generally level slab 4. In some embodiments, the track beam 7 may be referred to as a rail or carriage rail. A carriage 19 is moveably mounted on a lower flange of the track beam 7 in a manner similar to that shown in my prior U.S. Pat. No. 9,315,955 incorporated herein by reference. A component support frame 20 is connected to and suspended below the carriage 19 to move longitudinally, fore and aft, relative to the track beam 7 on carriage 19.

Figure 10:
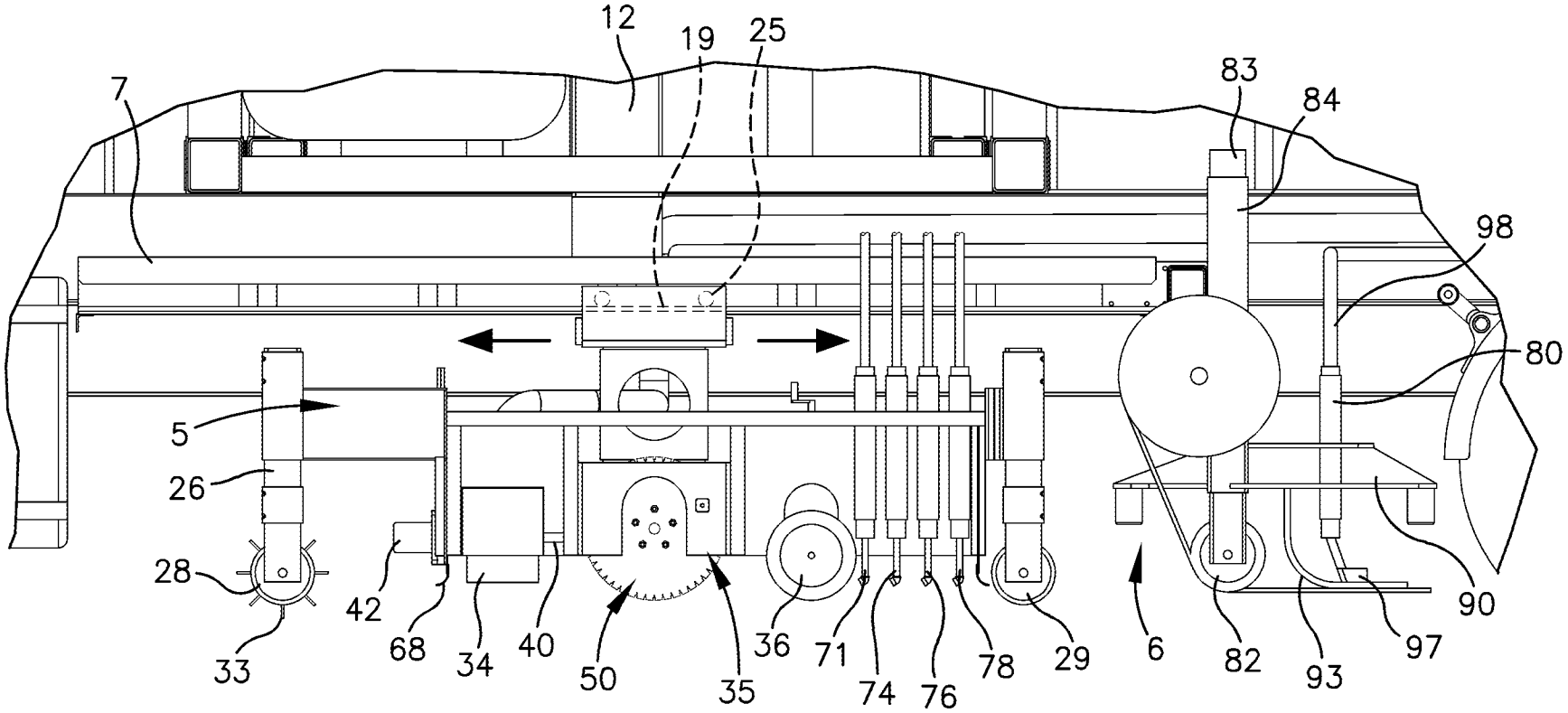
FIG. 10 is a side view of the joint seal removal assembly and joint fill assembly of FIG. 4 with the housing for the joint seal removal assembly removed to show detail thereof.
Figure 11:
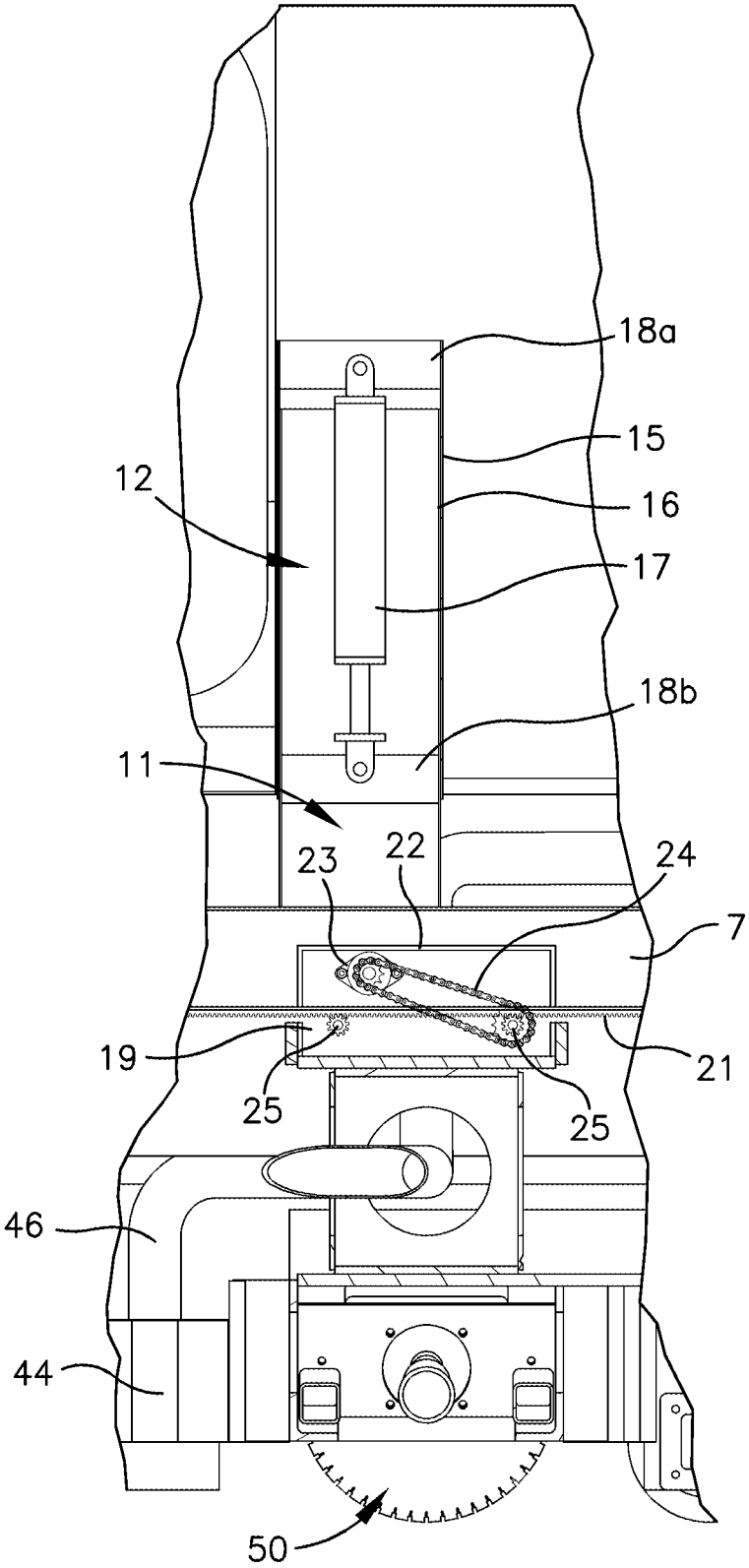
FIG. 11 is a cross-sectional view of a mast and mast support subframe forming a portion of the mobile joint seal removal and fill machine taken along line 11-11 of FIG. 5.

To enable movement of the carriage 19 relative to the track beam or rail 7 one or more rack gears 21 is mounted to an underside of the lower flange of the track beam 7 which is engaged by a drive assembly 22 on the carriage 19 for propelling the carriage 19 longitudinally along the track beam 7. drive assembly 22 As shown schematically in FIG. 10, the drive assembly 22 may include a motor 23 having a drive sprocket driving a chain 24 which drives a drive gear 25 which engages the rack gear 21 to selectively move the carriage 19 along the track beam 7 in either direction, forward or rearward. Roller bearings 27 on the carriage 19 engage an upper surface of the lower flange of track beam 7 to secure the carriage 19 on the track beam 7. In the preferred embodiment, the motor 23 is a hydraulic motor, although it is foreseen that other motor types, including but not limited to electric motors and combustion engines, may be used as well. It is also foreseen that the drive assembly 22 may alternatively include a pulley system and/or timing belt to facilitate the movement of the carriage 19 along the track beam 7.

Referring now to FIGS. 4, 7, and 10, the joint seal removal assembly 5 includes the component support frame 20 attached to and suspended from the carriage 19 mounted on the track beam 7. The assembly 5 further includes a first height-adjustable support post or leg 26 disposed at a first end of the component support frame 20, and a second height-adjustable support post or leg 27 disposed at a second end of the component support frame 20. The support posts 26 and 27 may be telescoping assemblies which allow for selective adjustment relative to the component support frame 20. In some embodiments, it may be desirable to lock the heights of the support posts 26 and 27 relative to the component support frame 20. This may be done using a set screw or the like, as well as a locking pin configured to engage with both the component support frame 20 and the legs 26 and 27.

Figure 8:
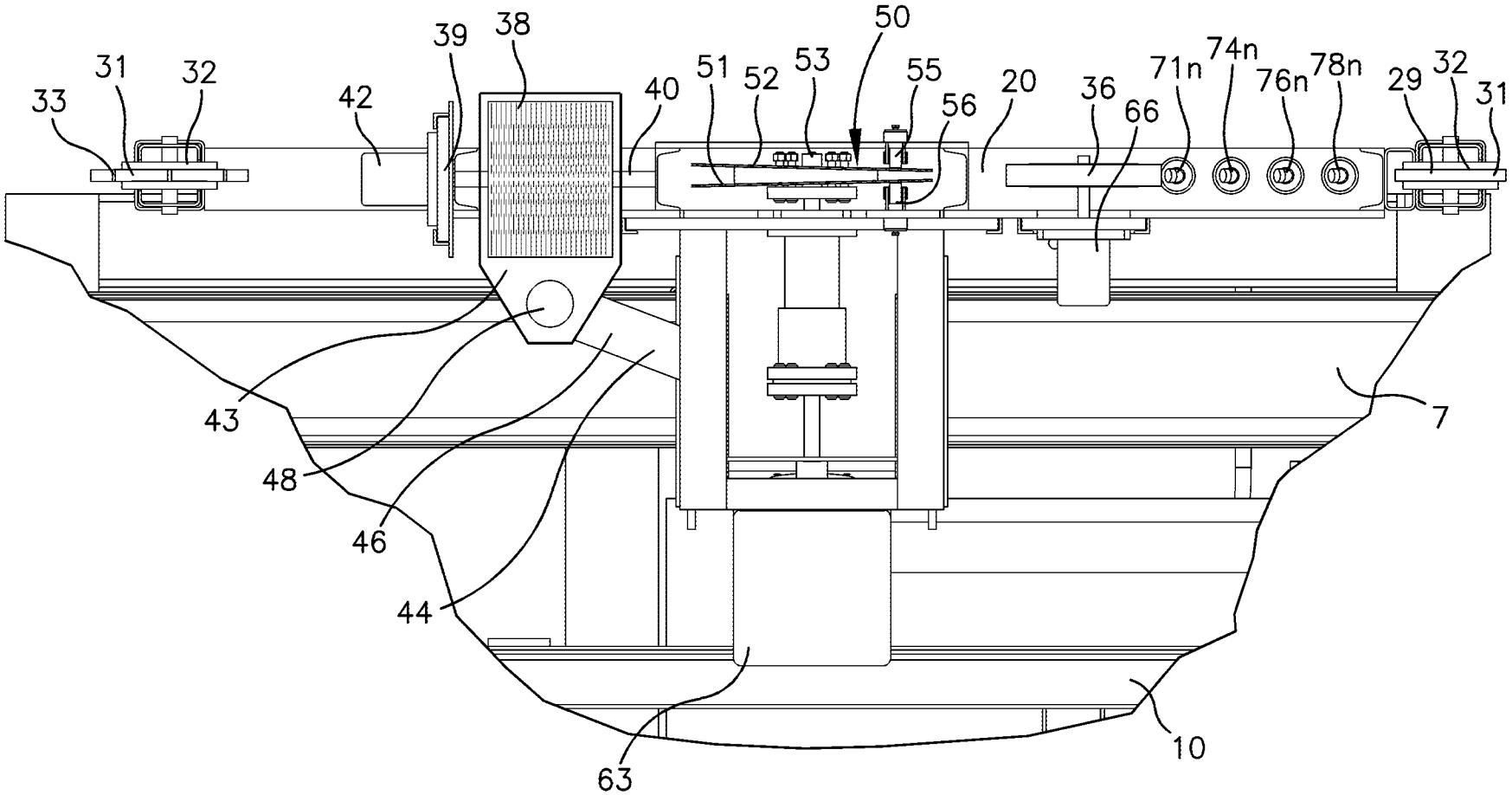
FIG. 8 is a fragmentary bottom view of the joint seal removal assembly of FIG. 4 with the housing for the joint seal removal assembly removed.

A first guide wheel 28 is rotatably mounted on a lower end of the leg 26, and a second guide wheel 29 is rotatably mounted on a lower end of the leg 27. It is foreseen that in some embodiments, the guide wheels 28 and 29 may alternatively be referred to as roller supports and/or alignment wheels. The guide wheels 28 and 29 may have a stepped or variable diameter across their width, as can be seen in FIGS. 4 and 8. Preferably, the guide wheels 28 and 29 have a central portion 31 having a larger diameter, and outer portions 32 having a diameter smaller than the central portion. This allows the central portion 31 of each guide wheel 28 and 29 to sit within the roadway joint 3 while the outer portions 32 sit on the upper surface of the slabs 4 on either side of the joint 3 so that the guide wheels 28 and 29 guide the joint seal removal assembly 5 along the joint 3 to provide improved accuracy and quality of the process of removing and replacing the joint seal.

A plurality of tools or components which perform a variety of functions for removing an existing joint seal and cleaning and preparing the joint 3 and for filling with a new joint seal are mounted on the component support frame 20 generally along a plane extending through the central portion 31 of the guide wheels 28 and 29 so that each tool or component is positioned to act on the existing joint seal or joint 3.

In some embodiments, such as the illustrated embodiment, the first guide wheel 28 may include a plurality of knives or blades 33 extending radially outward from the central portion 31 of the guide wheel 28. The blades 33 may be used for cutting and/or punching through the existing polymeric or tar joint seal to cut the existing seal into discrete segments to facilitate removal of the existing seal from the joint 3. The blades 33 may be mounted normal to an external surface of the guide wheel 28 or may be angularly offset from the surface at a non-perpendicular angle if desired.

Mounted on the component support frame 20 from the first guide wheel 28 towards the second guide wheel 29, the joint seal removal assembly 5 of the embodiment shown in FIGS. 1-11 includes a rotary broom 34, a joint seal router 35, a rotary abrader 36 and a plurality of joint treatment applicators 37 for directing streams of pressurized air, water and sand or a flame into the joint 3. The joint seal router 35 cuts into and separates the existing joint seal from the sides of the slabs 4 forming the joint 3 or grinds the existing joint seal out of the joint 3. The rotary abrader 36 abrades joint material away from the sides of the slabs 4 forming the joint 3 and the surface treatment applicators 37 further clean out the joint 3 and dry or heat the joint 3 in preparation of filling the cleaned joint 3 with new joint sealing materials. The rotary broom 34 sweeps away from the joint 3 joint material and other debris dislodged from the joint 3 by the joint seal router 35, rotary abrader 36 and the joint treatment applicators 37. The rotary broom 34 may also be referred to as a rotary sweeper. The length of the first and second height-adjustable support legs 26 and 27 is adjustable to adjust the depth that the joint seal router 35 and rotary abrader 36 extend into the joint 3.

An axis of rotation of the rotary broom 34 extends in alignment with a vertical plane extending through the central portion 31 of guide wheels 28 and 29 and in the direction of travel of the component support frame 20. Preferably, the rotary broom 34 is mounted to the component support frame 20 such that when in operation tips of bristles 38 of the rotary broom 34 engage the upper surface of the slabs 4 adjacent the joint 3 to engage and direct debris thereon to one side of the joint seal removal assembly 5. The rotary broom 40 sweeps away fragments of the current joint seal which have been cut or milled and dislodged from the joint 3 by the joint seal router 35, the rotary abrader 36 and the joint treatment applicators 37.

In the embodiment shown, a shaft 40 of the rotary broom 34 is rotatably mounted on support arms 39 comprising part of the component support frame 20. The shaft 40 and attached bristles 38 are driven by a motor 42 mounted to one of the support arms 39 to rotate the shaft 40 and bristles 38 about a longitudinally extending substantially horizontal axis. This axis is preferably situated such that the rotating broom 34 sweeps the debris to a side of the joint 3. The motor 42 may take the form of a hydraulic motor, such as in the illustrated embodiment, or alternatively may be an electric motor, or any motor now known or later developed. Alternatively, the rotary broom 34 may be driven by a common power source which also drives the joint seal router 35 and rotary abrader 36 with a separate power transmission coupling the rotary broom 34 to the power source which could for example comprise a combustion engine.

The rotary broom 34 may be partially covered or enclosed by a housing 43 mounted to the component support frame 20. It is foreseen that in certain embodiments, the housing 43 may be referred to as a shroud, covering, or enclosure. The shroud 43 preferably covers or encloses an upper portion of the rotary broom 34. The housing 43 may assist in containing the debris swept by the rotary broom 34 to a confined location.

In a preferred embodiment, a debris collection system 44 is incorporated into the joint removal and fill machine 1 for collecting debris swept away from the joint 3 by the rotary broom 34. In the embodiment shown, the debris collection system 44 includes a vacuum fan or blower 45 connected inline to a debris conduit 46 and between the shroud 43 and a debris receptacle 47 for pulling debris through an outlet 48 in the rotary broom shroud 43 and discharging it into the debris receptacle 47. The fan 45 and debris receptacle 47 are preferably mounted on the vehicle frame 9 and at least a portion of the debris conduit 46 extending between the fan 45 and the shroud 43 is flexible to permit movement of the shroud 43 relative to the fan 45 as the joint seal removal assembly 5 on carriage 19 moves on the track beam 7. It is to be understood that the vacuum fan 45 may also be mounted to the component support frame 20 with a portion of the debris conduit 46 extending between the fan 45 and the receptacle 47 being flexible to accommodate movement of the fan 45 relative to the receptacle 47. The debris collection system 44 is configured to intake debris from the rotary broom 34 via the outlet 48 in shroud 43, and deposit the debris into a receptacle 47. This may further improve the joint cleaning process, and may also minimize the potential for excess waste left on the roadway after completion of the joint removal and filling process.

In other embodiments not shown, the joint seal removing assembly 5 may include alternative means for containing or removing debris. In one embodiment, the fan 45 of the debris collection system 44 may be operated to blow pressurized air through a separate conduit (not shown) into an inlet opening (not shown) in the shroud 43 on a side of the broom 34 opposite the outlet 48 to blow a stream of air across the joint 3 and direct the debris entrained in the stream of air out the outlet 48 through conduit 46 and into receptacle 47. The compressed air source may be disposed adjacent the rotary joint cleaning element 34 on an opposite end to the first guide wheel 25 guide wheel 25. The inlet opening in the shroud 43 would preferably be oriented to direct the stream of air substantially perpendicularly to the roadway joint 3, or angularly offset from the joint 3. The shroud 43 may be constructed to form or include an initial debris collection receptacle proximate the outlet 48 and disposed on an opposite side of the roadway joint 3 from the inlet. The initial debris collection receptacle may be connected to a vacuum system or other means for moving the debris to a secondary, preferably larger, receptacle such a s receptacle 47.

In operation, and as discussed hereafter, the joint seal router 35 is rotated so that cutting edges of the router 35 move from rearward to forward through the joint 3 causing removed pieces of the existing joint seal to be thrown out of the joint 3 and forward of the router 35 and into the path of the rotary broom 34. In addition, while joint removal and fill machine 1 is moving forward relative to the joint 3, the carriage 19 and attached joint seal removal assembly 5 can be moved forward and rearward on the track beam 7. The carriage 19 and attached router 35 may initially move forward ejecting portions of the existing joint seal in front of the router 35 and then the carriage 19 may be advanced rearward so that the rotary broom 34 and its housing or shroud 43 connected to the debris collection system 44 are advanced over the debris ejected from the joint 3 with the broom 34 sweeping the debris toward the shroud outlet 48 where the debris is then pulled through the debris conduit 46 by the vacuum fan 45 and ejected into the receptacle 47.

Figure 9:
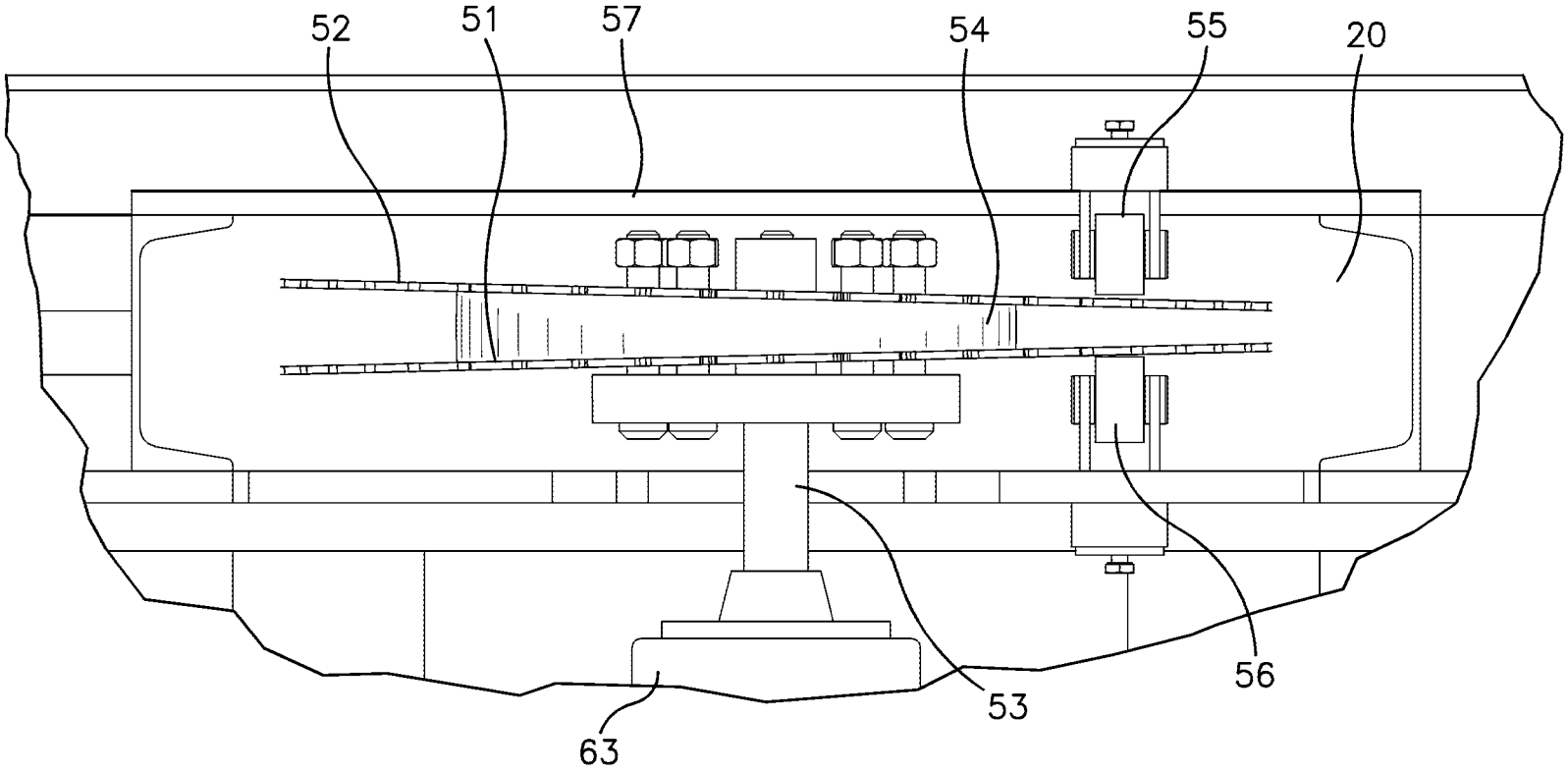
FIG. 9 is an enlarged fragmentary bottom view of the joint seal removal assembly showing the circular saw assembly as a joint seal router.

Referring to FIGS. 8 and 9, the joint seal router 35 is mounted to the component frame 20 rearward of the rotary broom 34. In the embodiment shown in FIGS. 1-11, the joint seal router 35 comprises a circular saw assembly 50 with a pair of circular saw blades 51 and 52 which rotate about a horizontal axis extending laterally relative to the direction of travel of the machine 1.

The first and second circular saw blades 51 and 52 are mounted on a common axle 53 which extends transverse to the direction of travel of the machine 1. The saw assembly further includes a resilient or compressible annular spacer 54 disposed between and abutting saw blades 51 and 52. The resilient annular spacer 54 may be tapered in some embodiments, so as to accommodate compression of the saw blades 51 and 52 closer together along a portion of a path of rotation of the saw blades 51 and 52. In the embodiment shown, the blades 51 and 52 are pressed closer together along a rear portion of the path of rotation of the blades 51 and 52. The spacer 54 is preferably appropriately sized such that leading edges of the saw blades 51 and 52 are spaced wider apart as they rotate upward and outward from the joint 3 to better cut opposite sides of the joint seal away from the road joint 3. The resilience of the spacer 54 allows compression of the leading edges of the saw blades 51 and 52 as they rotate through the joint 3 to reduce the possibility of unwanted damage to the circular saw assembly 50.

The saw assembly includes adjustable cam bearings 55 and 56 mounted on a saw blade housing or shroud 57 and extendable toward and away from the outer faces of saw blades 51 and 52, respectively. The cam bearings 55 and 56 may be adjusted to engage the outer faces of the saw blades 51 and 52 rearward of the common axle 53 and to the extent necessary to bias the saw blades 51 and 52 closer together rearward of the common axle 53 and further apart in front of the axle 53 to obtain a desired angular orientation of the saw blades 51 and 52. The saw blade shroud 57 preferably covers the upper portion of the saw blades 51 and 52 through their path of rotation with enough of the saw blades 51 and 52 extending below the shroud 57 as is necessary to extend to the desired depth of cut of the saw blades 51 and 52 in the joint 3.

Figure 12:
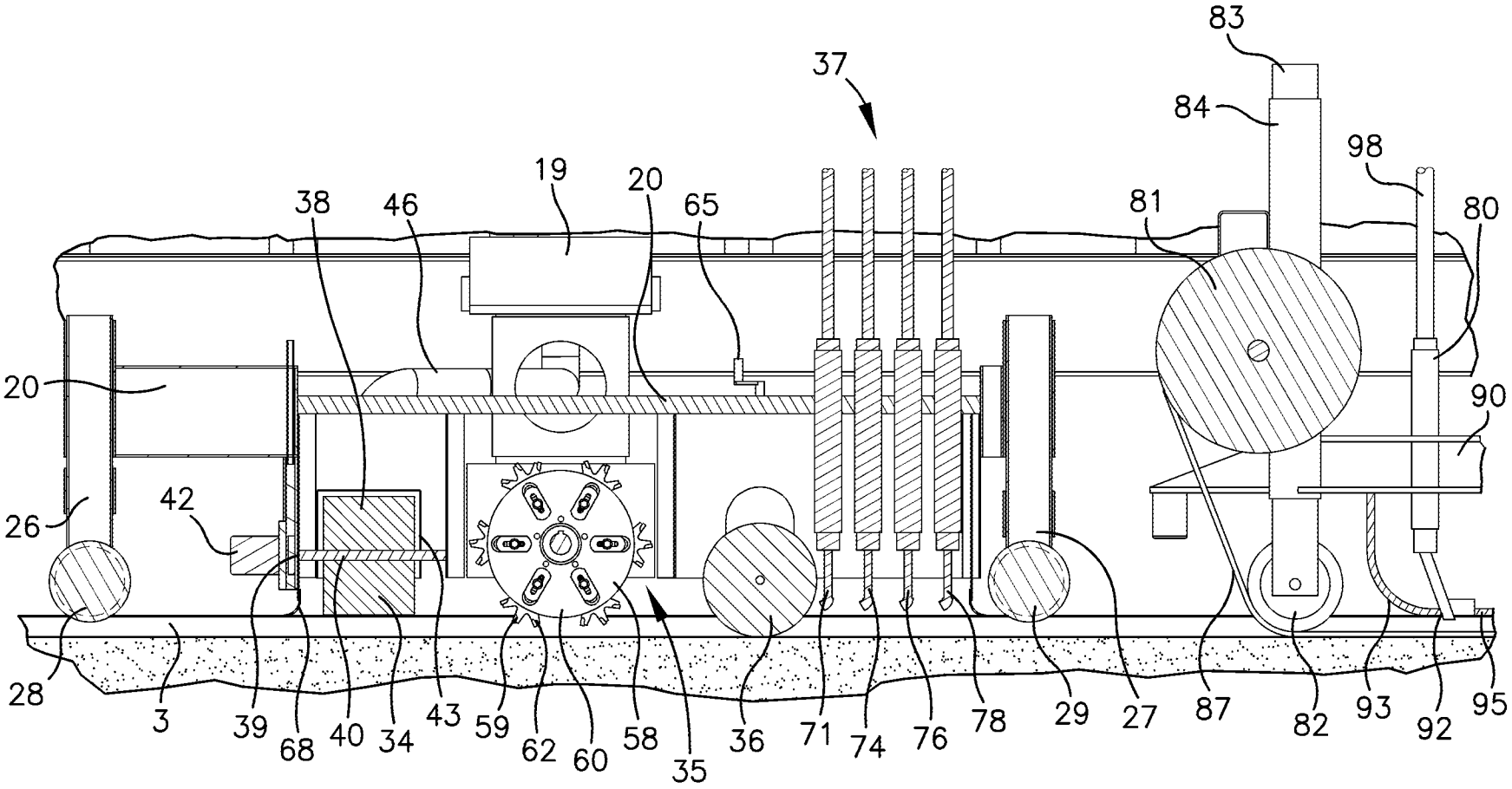
FIG. 12 is a fragmentary cross-sectional view of an alternative embodiment of the mobile joint seal removal and fill machine similar to FIG. 7 and showing an asphalt joint router as the joint seal router.
Figure 13:
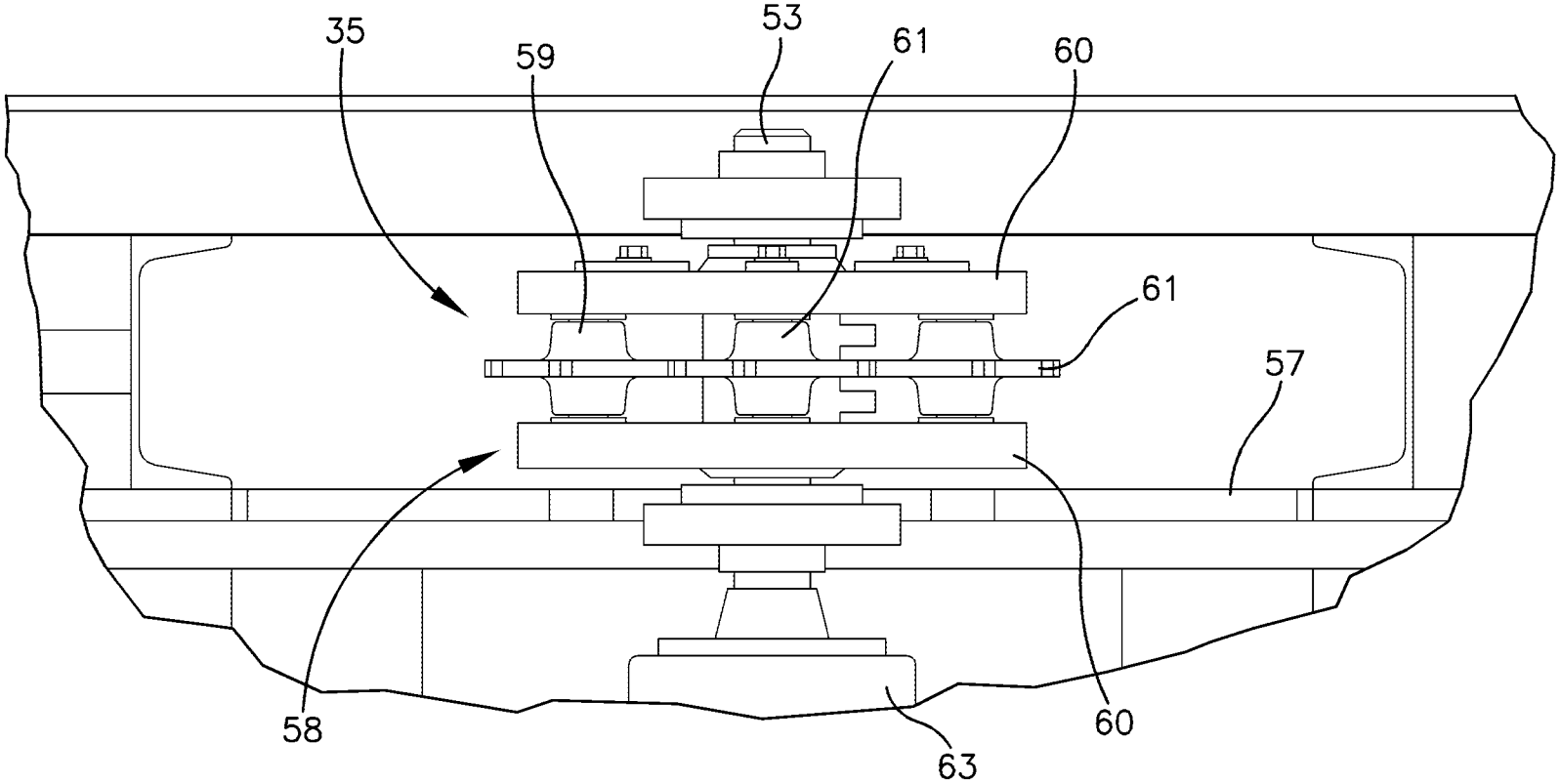
FIG. 13 is an enlarged fragmentary bottom view showing detail of the asphalt joint router of the alternative embodiment of the mobile joint seal removal and fill machine as shown in FIG. 12.

In applications involving asphalt cold joints, it may be desirable for the joint seal router 35 to be a pavement milling type router, also known as an asphalt joint router 58. Pavement routers are known by those skilled in the art and are commercially available via distributors such as CRAFCO. In the embodiment of the joint seal removal and fill machine 1 shown in shown in FIGS. 12 and 13, the joint seal router 35 shown is an asphalt joint router 58 which is mounted to the component support frame 20 similar to the circular saw assembly 50 disclosed previously. The asphalt joint router 58 is configured to rotate about the axle 53 and may include a plurality of pavement cutters 59 rotatably mounted between a pair of flange plates 60. Each cutter 59 may be formed as a rotating hammer assembly with a plurality of arms 61 with hardened hammers 62 facing in the direction of rotation of the hammer assembly. When the asphalt joint router 58 is used, the blades 33 on the first guide wheel 28 are not necessary and therefore a guide wheel 28 without blades 33 may be used as shown.

It may be particularly beneficial for the circular saw assembly 50 and the asphalt joint router 58 to be interchangeably mountable on the component support frame 20. In the preferred embodiment, the common axle 53 may be configured to engage a plurality of various cutting assemblies, such that a user may be able to remove one assembly and install another. For instance, a single machine 1 may be used to remove and repair a joint seal along a concrete roadway utilizing the circular saw assembly 50 disclosed, and then subsequently be used to repair a joint seal in an asphalt roadway after removing the saw assembly 50 and installing the asphalt joint router 58. As used herein, the circular saw assembly 50 and the asphalt joint router 58 may each be referred to as a router or joint seal router 35. The vertical position of the axle 53 of the joint seal router 35 relative to the component support frame 20 or shroud 57 is adjustable to adjust the depth of cut of the joint seal router 35 in a joint 3.

In the embodiment shown, the joint seal router 35 is driven by a motor 63 which is mounted on the component support frame 20 and drives the axle 53. This motor 63 may be a hydraulic motor, such as in the preferred embodiment, although those of skill in the art will appreciate that the motor may be an electric motor, a combustion engine, or other motor type now known or later developed. Motor 63 may also be used to drive the rotary broom 34 and rotary abrader 36 through an appropriate power transmission assembly, such as a chain and sprocket transmission.

In the embodiment shown, the rotary abrader 36 is mounted on the component support frame 20 behind and substantially coplanar to or longitudinally aligned with the joint seal router 35. The rotary abrader 36 may take the form of a wire brush, such as in the illustrated embodiment, and may be referred to as a wire brush interchangeably. The wire brush 36 may be rotatable about a substantially horizontal axis extending transverse to the direction of travel of the machine 1, and substantially parallel to the axle 53 of the joint seal router 35.

The wire brush 36 may be used to abrade away from the sides of the slabs 4 forming the joint 3 fragments or particles of the joint material which remain adhered thereto. To improve effectiveness of the material removal, the wire brush 36 may be mounted upon a height-adjustable mounting assembly 64, to allow the depth that the wire brush 36 extends into the joint 3 relative to the other components and the component support frame 20 to be adjusted. This assembly may be manually adjustable, such as via a hand crank 65 as shown in FIG. 10, or may be adjusted using a hydraulically or electrically operated linear actuator (not shown).

The rotary abrader 36 may be driven by a motor 66 mounted upon the component support frame 20. This motor 66 may be a hydraulic motor, such as in the preferred embodiment, although those of skill in the art will appreciate that the motor may be an electric motor, a combustion engine, or other motor type now known or later developed. As discussed previously, rotary abrader 36 may be driven by a power transmission connected to a common power supply or motor such as motor 63 for joint seal router 35.

The joint treatment applicators 37, shown schematically in the Figures, are mounted on the component support frame 20 rearward of the rotary abrader 36 with nozzles, orifices, or outlets directed toward the joint. Each of these applicators are mounted to the component support frame 20 substantially coplanar to or longitudinally aligned with the rotary abrader 36 and the joint seal router 35. Each nozzle may provide additional joint cleaning and preparation before the joint is filled.

Referring to FIG. 7 and moving from the rotary abrader 36 to the second guide wheel 29, these applicators 37 may include a sandblaster 71, a high-pressure air blaster 74, a high-pressure water blaster or pressure washer 76, and a heat lance 78. The sandblaster 71 is operable to direct a stream of air with sand entrained therein to further remove residual joint fill material from the sides of the slabs 4 forming the joint 3 that has not been removed by the preceding components. The sandblaster 71 may be connected to a source of sand 72 and compressed air 73 which may be mounted on the base frame 9 or on the vehicle frame 10. The high-pressure air blaster or air wand 74 may be used to blow loose or dislodged material from the joint 3, and may be connected to at least one compressed air cylinder or air compressor 75 stored on the vehicle 10 or attached to the base frame 9. The high-pressure water blaster or pressure washer 76 similarly uses at least one high pressure water stream directed at the joint 3 to remove loosened material and clean the joint 3, and may be connected to a water tank 77 mounted to the base frame 9 or on the vehicle frame 10 and a water pump (not shown). Finally, a heat lance or burner 78, which may be connected to a fuel source 79 stored on the vehicle frame 10, may serve to dry out the joint 3 and heat the sides of the slab 4 forming the joint 3 prior to application of the replacement seal, which may greatly increase adhesion of the replacement joint seal material, such as tar, to the slabs 4 adjacent the joint 3.

The sandblaster 71, air blaster 74, pressure washer 76, and heat lance 78 may each include respective nozzles 71*n*, 74*n*, 76*n*, and 78*n* directed downwards towards the joint. Each nozzle may be disposed at an angle relative to a vertical axis, such as in the illustrated embodiment, which may improve the joint treatment quality. It is foreseen that in some embodiments, the nozzles 71*n*, 74*n*, 76*n*, and 78*n* may be independently and/or variably adjustable to suit the needs of the application.

Although in the illustrated embodiment there are four distinct types of joint treatment applicators 37, those of ordinary skill in the art will appreciate that certain embodiments and/or applications may omit the use of certain applicators. For example, the application or user may not deem the high-pressure water blaster 76 necessary for the application, and therefore the high-pressure water blaster 76 may be removed from the component support frame 20 or simply left in place but not used. In addition, the order, positioning and arrangement of the joint treatment applicators 37 on the component support frame 20 may be varied.

The joint seal removing assembly 5 may also include a shroud or housing 67 which substantially encloses the assembly components described above including the rotary broom 34, the joint seal router 35, the rotary abrader and the joint treatment applicators 37. As illustrated in FIG. 4, this shroud or housing 67 may be removably attached to the component support frame 20. The housing 67 functions to further contain debris dislodged form the joint by the joint seal removing and cleaning components, which may reduce the risks to nearby workers and facilitate sweeping up of the debris by the rotary broom 34 and the debris collection system 44. The shroud 4 preferably includes a skirt or sealing flaps 68, which may be disposed along a portion of a lowermost edge of the shroud 67. This skirt 68 may allow the joint seal removal assembly 5 to be more substantially enclosed or "sealed" to the roadway, which may be beneficial for embodiments which include a vacuum system. The flaps 68 are preferably formed from a flexible or resilient material such as rubber, which may provide an increased seal along uneven road surfaces.

Turning now to the joint fill assembly 6, the joint fill assembly 6 is mounted or connected to an end of the track beam 7 and extends rearward therefrom in alignment with the components of the joint seal removal assembly 5. The joint fill assembly 6 of the embodiment shown includes a sealant applicator 80, a backer rod spool 81 and a backer rod press wheel 82. The backer rod press wheel 82 is mounted on the lower end of a height-adjustable telescoping support leg 83. The support leg 83 is telescopically or slidingly secured within a sleeve or support leg receiving tube 84 fixedly connected to a rear end of the track beam 7. The backer rod press wheel 82 may alternatively be referred to as a guide wheel. Similar to the guide wheels 28 and 29, the press wheel 82 of the embodiment shown includes a central portion 85 having a larger diameter than outer portions 86 extending on each side of the central portion 85, in order to allow for the central portion 85 of the press wheel 82 to extend within the joint 3 while the outer portions 86 roll on the upper surface of the slabs 4 adjacent the joint 3.

The backer rod spool 81 is rotatably mounted on the support leg receiving tube 84 and rotatable about a substantially horizontal axis which is transverse to the direction of travel of the machine 1. The backer rod spool 81 is configured to hold and dispense a length of backer rod 87 for use as a base layer in the joint filling process. The backer rod 87 is typically formed from a resilient and flexible material such as foam, rubber, or a similar polymeric material known by those of skill in the art. The spool 81 may dispense the backer rod 87 such that the backer rod 87 may be threaded beneath the backer rod press wheel 82. The larger-diameter central portion 85 of the press wheel 82 presses the backer rod 87 within the cleaned joint 3, while the smaller-diameter outer portions 86 ride along the top of the adjacent slabs 4 of the roadway.

The sealant applicator 80 may be mounted on a support arm or support bracket 90 which is rigidly attached to the tube 84 in which the telescoping support leg 83 is received. The support bracket 90 may be configured to hold the sealant applicator 80 rearward of the press wheel 82 and in substantially coplanar and longitudinal alignment with the press wheel 82 and the components of the joint seal removal assembly 5. The sealant applicator 80 includes an applicator nozzle 92 directed toward the joint for dispensing or injecting a joint sealant material, such as tar or a curable rubberized or resilient sealing material into the joint 3 and over the backer rod previously pressed into the joint 3.

A sealant containment flap 93 may be attached to and hand downward from the support bracket 90 between the press wheel support leg 83 and the sealant applicator 80. The flap 93 is preferably formed from a flexible material such as rubber and of sufficient length such that a distal portion 95 of the flap curves rearward as it is dragged over the slabs 4 and over the top of the joint 3 while the vehicle is in motion. The sealant containment flap 93 includes a slot or through hole 96 through which a tip of the sealant applicator nozzle 92 extends such that the nozzle 92 passes through the flap 93 to dispense the sealant into the joint 3. An upstanding rim 97 may be formed around the hole 96 to facilitate holding of the nozzle 92 in the through hole 96. The flap 93 may smooth or level the sealant injected into the joint 3 through the sealant applicator nozzle 92 and contain the sealant within the joint 4. The sealant applicator 80 is connected by a sealant supply tube 98 to a sealant supply tank 99 which in the embodiment shown is mounted on the vehicle frame 9. A sealant pump (not shown) is operable to supply fluid sealant to the sealant applicator 80 under pressure for discharge through the applicator nozzle 92.

Mounting of the joint seal removal assembly 5 on the carriage 19 which is movably mounted on the track beam 7 for longitudinal movement relative thereto while fixedly mounting the joint seal fill assembly 6 relative to the respective track beam 7 allows movement of the joint seal removal assembly 5 back and forth on the track beam 7 while the joint seal fill assembly 6 moves forward or remains stationary. In most applications, it is undesirable to have to move the joint seal fill assembly 6 in reverse as doing so can break the unspooled backer rod 87 and dislodge sealant already applied over the installed portion of the backer rod 87. It is contemplated that the carriage 19 and attached joint seal removal assembly 5 may be moved forward and rearward on the track beam 7 while the machine 1 is moving forward such that each component of the joint seal removal assembly 5 passes over each section of the joint 3 two or three times to remove the existing seal and clean and prepare the joint 3 to the desired extent.

To improve joint tracking ability, in some embodiments the machine 1 may include an auxiliary joint alignment assembly 110, seen in FIGS. 1-3, 5, and 6. The alignment assembly 110 may be mounted to the front of the vehicle 10. The assembly 110 may have at least one guide wheel 111 disposed at an end of an axle 112. The guide wheel 111 is configured to fit within the width of the desired roadway joint 3, which may assist the machine's operator and/or the vehicle driver in aligning the joint seal removal and joint fill assemblies 5 and 6, respectively with the joint 3 from which a seal is to be removed and replaced. The axle 112 may be telescopically adjustable and extend outward from a central portion of the alignment assembly. The axle 112 may be telescopically adjusted using hydraulic or electric motors, as well as being passively adjustable. In some embodiments, the auxiliary joint alignment assembly 110 may include an actuator (not shown) configured to raise and lower the assembly 110 with respect to the road.

It is foreseen that in some embodiments, the alignment assembly 110 may further include sensors which detect the position of the guide wheel 111. This data may be stored and/or used to adjust the position of the joint seal removal assembly 5 and the joint filling assembly 6 by expanding or contracting the base frame 9. By adjusting the position of the joint seal removal assembly 5 and joint fill assembly 6 in real-time, the time required to remove and replace a seal may be decreased.

A control system 120 for the components of the joint seal removal assembly 5 and joint fill assembly 6 is shown mounted on the base frame 9 in front of an operator's seat 122. An operator seated at seat 122 may use the control system 120 to control the operation of the mobile joint seal removal and fill machine 1 including the joint seal removal and joint fill assemblies 5 and 6, the expandable subframe 11, the mast 12 and the vehicle 2 as well as other components of the machine 1.

Many of the supply lines for connecting sand, pressurized air, pressurized water and fuel to the applicators 37 and hydraulic fluid to the hydraulic motors and actuators described herein or all of the conduit for connection to the vacuum fan or blower are not shown to simplify the views provided.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims.

What is claimed is:

1. A machine for removing and replacing a joint seal from a joint between slabs, the machine comprising:

a frame;

a joint seal router mounted on the frame and operable to remove the joint seal from the joint; and a sealant applicator mounted on the frame in longitudinal alignment with the joint seal router and having a dispensing nozzle positionable to dispense joint seal material in the joint, wherein the joint seal router comprises a circular saw including first and second saw blades mounted on an axle for rotation therewith, a compressible spacer disposed between the first and second saw blades, and first and second blade engaging bearings positioned in spaced relation from the axle to engage an outwardly facing surface of the respective first and second saw blades to angularly offset a path of rotation of each of the first and second saw blades relative to a direction of travel of the machine.

2. A machine for removing and replacing a joint seal from a joint between slabs, the machine comprising:

a main frame;

a track beam suspended from the main frame;

a joint seal removing assembly mounted on a carriage which is moveably mounted on the track beam and operable to move longitudinally in either direction along the track beam; the joint seal removing assembly comprising a joint seal removing means for removing the joint seal from the joint; and a joint seal filling assembly mounted on the machine in a fixed longitudinal position relative to the track beam, the joint seal filling assembly comprising a sealant applicator having a dispensing nozzle positionable to dispense joint seal material in the joint.

3. The machine as in claim 2 wherein the joint seal removing means comprises a joint seal router.

4. The machine as in claim 2 wherein said track beam is telescopically suspended from the main frame.

5. The machine as in claim 4 wherein said track beam is rotatable relative to the main frame about a vertical axis.

6. The machine as in claim 5 further comprising a component support frame connected to said carriage and a first guide wheel depending from the component support frame, the first guide wheel having a guide portion positionable in the joint for guiding the joint seal removing assembly relative to the joint.

7. The machine as in claim 6, wherein the first guide wheel includes a plurality of blades extending radially outward from a periphery of the guide portion of the first guide wheel.

8. The machine as in claim 2 further comprising a component support frame connected to said carriage and wherein the joint seal removing means comprises a joint seal router connected to the component support frame on an axle extending approximately perpendicular to a direction of travel of the machine.

9. The machine as in claim 8, wherein the joint seal router comprises a circular saw including first and second saw blades mounted on the axle for rotation therewith, a compressible spacer disposed between the first and second saw blades, and first and second blade engaging bearings positioned in spaced relation from the axle to engage an outwardly facing surface of the respective first and second saw blades to angularly offset a path of rotation of each of the first and second saw blades relative to the direction of travel of the machine.

10. The machine as in claim 9 wherein a lateral position of each of the first and second blade engaging bearings is laterally adjustable to adjust an angle of offset of the respective first and second saw blades relative to the axle.

11. The machine as in claim 8 wherein the joint seal router comprises an asphalt joint router mounted on the axle.

12. The machine as in claim 2, wherein the joint seal removing assembly further comprising a material collection system including a vacuum assembly configured to draw debris from a roadway into a debris collection system.

13. The machine as in claim 8 wherein the joint seal removing means further comprises a rotary abrader mounted on the component support frame behind the joint seal router.

14. The machine as in claim 8 wherein the joint seal removing assembly comprises a pressurized air applicator mounted on the component support frame behind the joint seal router, the pressurized air applicator including a pressurized air nozzle connected to a source of pressurized air, the pressurized air nozzle positioned to direct a stream of pressurized air into the joint.

15. The machine as in claim 8 wherein the joint seal removing assembly comprises a pressurized water applicator mounted on the component support frame behind the joint seal router, the pressurized water applicator including a pressurized water nozzle connected to a source of pressurized air, the pressurized water nozzle positioned to direct a stream of pressurized air into the joint.

16. The machine as in claim 8 wherein the joint seal removing assembly comprises a sand blaster mounted on the component support frame behind the joint seal router, the sand blaster having a sand blaster nozzle connected to a source of pressurized air and sand, the sand blaster nozzle positioned to direct a stream of sand entrained in pressurized air into the joint.

17. The machine as in claim 8 wherein the joint seal removing assembly comprises a heat lance mounted on the component support frame behind the joint seal router, the heat lance including a heat lance head connected to a fuel source, the heat lance head positioned to direct a flame into the joint.

18. A machine for removing and replacing a joint seal from a joint between slabs, the machine comprising:

a main frame;

a track beam suspended from the main frame on a telescoping and rotating mast;

a joint seal removing assembly mounted on a carriage which is moveably mounted on the track beam and operable to move longitudinally in either direction along the track beam; the joint seal removing assembly including a joint seal router extending in longitudinal alignment operable to remove the joint seal from the joint;

a joint seal filling assembly mounted on the machine in a fixed longitudinal position relative to the track beam, the joint seal filling assembly comprising a sealant applicator having a dispensing nozzle positionable to dispense joint seal material in the joint; and a guide wheel connected to and depending from the track beam wherein a portion of the guide wheel is insertable into the joint to cause the track beam to rotate into longitudinal alignment with the joint.

19. The machine as in claim 18 further comprising a component support frame connected to said carriage and the guide wheel comprises a first guide wheel depending from the component support frame.

20. The machine as in claim 19, wherein the first guide wheel includes a plurality of blades extending radially outward from a periphery of a guide portion of the first guide wheel.

21. The machine as in claim 18 further comprising a component support frame connected to said carriage and wherein the joint seal router is connected to the component support frame on an axle extending approximately perpendicular to a direction of travel of the machine.

22. The machine as in claim 18 wherein the joint seal router comprises a circular saw including first and second saw blades mounted on an axle for rotation therewith, a compressible spacer disposed between the first and second saw blades, and first and second blade engaging bearings positioned in spaced relation from the axle to engage an outwardly facing surface of the respective first and second saw blades to angularly offset a path of rotation of each of the first and second saw blades relative to a direction of travel of the machine.

23. The machine as in claim 22 wherein a lateral position of each of the first and second blade engaging bearings is laterally adjustable to adjust an angle of offset of the respective first and second saw blades relative to the axle.

24. The machine as in claim 18 wherein the joint seal removing assembly further comprises a material collection system including a vacuum assembly configured to draw, from the slabs and into a debris collection system, the joint seal removed from the joint.

25. The machine as in claim 19 wherein the joint seal removing assembly comprises a rotary abrader mounted on the component support frame behind the joint seal router.

26. The machine as in claim 19 wherein the joint seal removing assembly comprises a pressurized air applicator mounted on the component support frame behind the joint seal router, the pressurized air applicator including a pressurized air nozzle connected to a source of pressurized air, the pressurized air nozzle positioned to direct a stream of pressurized air into the joint.

27. The machine as in claim 19 wherein the joint seal removing assembly comprises a pressurized water applicator mounted on the component support frame behind the joint seal router, the pressurized water applicator including a pressurized water nozzle connected to a source of pressurized air, the pressurized water nozzle positioned to direct a stream of pressurized air into the joint.

28. The machine as in claim 19 wherein the joint seal removing assembly comprises a sand blaster mounted on the component support frame behind the joint seal router, the sand blaster having a sand blaster nozzle connected to a source of pressurized air and sand, the sand blaster nozzle positioned to direct a stream of sand entrained in pressurized air into the joint.

29. The machine as in claim 19 wherein the joint seal removing assembly comprises a heat lance mounted on the component support frame behind the joint seal router, the heat lance including a heat lance head connected to a fuel source, the heat lance head positioned to direct a flame into the joint.

30. A machine for removing and replacing a joint seal from a joint between slabs, the machine comprising:

a main frame mounted on a base, a track beam rotatably suspended from the main frame;

a joint seal router moveably mounted on the track beam and laterally positionable to align the joint seal router with the joint; and a sealant applicator mounted on the track beam in longitudinal alignment with the joint seal router, the sealant applicator having a dispensing nozzle positionable to dispense joint seal material in the joint; wherein the main frame is telescopically extendable and retractable laterally relative to a direction of travel of the machine so that the track beam and the joint seal router and the sealant applicator mounted on the track beam are laterally positionable to align with the joint.

31. The machine as in claim 30 wherein the joint seal router comprises a first saw blade and second saw blade, and a path of rotation of each of the first saw blade and the second saw blade is independently angularly offset relative to the direction of travel of the machine.

32. The machine as in claim 30 wherein the joint seal router is mounted on a carriage that is moveably mounted on the track beam and operable to move longitudinally in either direction along the track beam.

33. The machine as in claim 30 further comprising a guide wheel having a guide portion insertable into the joint to guide the joint seal router into alignment with the joint.

* * * * *